US009783746B2

(12) United States Patent
Dindi et al.

(10) Patent No.: US 9,783,746 B2
(45) Date of Patent: Oct. 10, 2017

(54) PROCESS FOR IMPROVING COLD FLOW PROPERTIES AND INCREASING YIELD OF MIDDLE DISTILLATE FEEDSTOCK THROUGH LIQUID FULL HYDROTREATING AND DEWAXING

(71) Applicant: E I DU PONT DE NEMOURS AND COMPANY, Wilmington, DE (US)

(72) Inventors: Hasan Dindi, Wilmington, DE (US); Sandeep Palit, Leawood, KS (US); Alan Howard Pulley, Lee's Summit, MO (US); Luis Eduardo Murillo, Wilmington, DE (US); Thanh Gia Ta, New Castle, DE (US); Brian Boeger, Westwood, KS (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 0 days.

(21) Appl. No.: 15/285,803

(22) Filed: Oct. 5, 2016

(65) Prior Publication Data

US 2017/0022432 A1 Jan. 26, 2017

Related U.S. Application Data

(63) Continuation of application No. 14/208,258, filed on Mar. 13, 2014, now Pat. No. 9,499,750.

(Continued)

(51) Int. Cl.

*C10G 65/04* (2006.01)
*C10G 45/22* (2006.01)

(Continued)

(52) U.S. Cl.

CPC ..... *C10G 65/043* (2013.01); *C10G 45/22* (2013.01); *C10G 45/58* (2013.01); *C10G 45/60* (2013.01); *C10G 45/62* (2013.01); *C10G 45/64* (2013.01); *C10G 49/20* (2013.01); *C10G 49/22* (2013.01); *C10L 1/08* (2013.01); *C10L 10/14* (2013.01); *C10L 10/16* (2013.01); *C10G 2300/1048* (2013.01); *C10G 2300/1055* (2013.01); *C10G 2300/202* (2013.01); *C10G 2300/301* (2013.01);

(Continued)

(58) Field of Classification Search

CPC ..... C10G 45/22; C10G 45/62; C10G 49/22; C10G 45/60; C10G 45/58; C10G 45/64; C10G 65/043; C10G 49/20; C10G 2300/202; C10G 2400/04; C10G 2300/44; C10G 2300/304; C10G 2300/1048; C10L 1/08

See application file for complete search history.

(56) References Cited

U.S. PATENT DOCUMENTS 5,100,535 A 3/1992 Chen et al.
6,123,835 A 9/2000 Ackerson et al.

(Continued)

OTHER PUBLICATIONS

International Search Report and Written Opinion, PCT/US2014/024190, dated Jul. 10, 2014.

(Continued)

*Primary Examiner* — Randy Boyer
*Assistant Examiner* — Juan Valencia

(57) ABSTRACT

Novel liquid-full process for improving cold flow properties and increasing yield of middle distillate fuel feedstock by hydrotreating and dewaxing the feedstock in liquid-full reactors.

18 Claims, 2 Drawing Sheets

Related U.S. Application Data

(60) Provisional application No. 61/781,438, filed on Mar. 14, 2013.

(51) Int. Cl.

| | |
|---|---|
| ***C10G 45/58*** | (2006.01) |
| ***C10G 45/60*** | (2006.01) |
| ***C10G 45/62*** | (2006.01) |
| ***C10G 45/64*** | (2006.01) |
| ***C10G 49/20*** | (2006.01) |
| ***C10G 49/22*** | (2006.01) |
| ***C10L 1/08*** | (2006.01) |
| ***C10L 10/14*** | (2006.01) |
| ***C10L 10/16*** | (2006.01) |

(52) U.S. Cl.

CPC ..... *C10G 2300/304* (2013.01); *C10G 2300/4006* (2013.01); *C10G 2300/42* (2013.01); *C10G 2300/44* (2013.01); *C10G 2300/802* (2013.01); *C10G 2400/04* (2013.01); *C10L 2200/0446* (2013.01); *C10L 2270/026* (2013.01)

(56) References Cited

U.S. PATENT DOCUMENTS

| | | | | |
|---|---|---|---|---|
| 7,569,136 | B2 | 8/2009 | Ackerson et al. | |
| 2005/0082202 | A1* | 4/2005 | Ackerson | C10G 45/22 208/213 |
| 2006/0144756 | A1 | 7/2006 | Ackerson et al. | |
| 2009/0095653 | A1 | 4/2009 | Kokayeff | |
| 2009/0326289 | A1 | 12/2009 | Petri et al. | |
| 2010/0176027 | A1 | 7/2010 | Oliveri et al. | |
| 2010/0187155 | A1 | 7/2010 | McCarthy et al. | |
| 2011/0219672 | A1* | 9/2011 | Novak | C10G 45/64 44/307 |
| 2011/0259793 | A1* | 10/2011 | Umansky | B01D 3/141 208/89 |
| 2012/0000829 | A1* | 1/2012 | Dougherty | C10G 21/003 208/264 |
| 2012/0004477 | A1 | 1/2012 | Dougherty et al. | |

OTHER PUBLICATIONS

Thakkar et al., LCO Upgrading, A Novel Approach for Greater Added Value and Improved Returns, UOP LLC, AM-05-53, pp. 1-15, 2005.

* cited by examiner

PROCESS FOR IMPROVING COLD FLOW PROPERTIES AND INCREASING YIELD OF MIDDLE DISTILLATE FEEDSTOCK THROUGH LIQUID FULL HYDROTREATING AND DEWAXING

CROSS-REFERENCE TO RELATED APPLICATION

This application is a Continuation of application Ser. No. 14/208,258 filed Mar. 13, 2014 which claims the benefit of U.S. Provisional Application 61/781,438, filed Mar. 14, 2013, each of which is incorporated by reference in its entirety.

BACKGROUND

Field of the Disclosure

The present disclosure relates to high yield liquid-full catalytic hydroprocesses for the production of middle distillate fuel with reduced sulfur and/or nitrogen content and improved cold flow properties.

Description of Related Art

Global demand for diesel, particularly for low-sulfur-middle diesel (LSD) and more particularly for ultra-low-sulfur-diesel (ULSD) has risen quickly with increased growth of transportation fuels and a decrease in the use of fuel oil. Regulations for transportation fuels have been established to substantially lower the sulfur levels in diesel fuels. There are other pending rules calling to reduce the sulfur content in off-road diesel as well. Thus, there is a growing need for improved diesel products, including LSD and ULSD. Hydroprocessing (or hydrotreating), such as hydrodesulfurization and hydrodenitrogenation, have been used to remove sulfur and nitrogen, respectively from hydrocarbon feeds.

Moreover, in cold weather climates there is a need for diesel fuels with improved cold flow properties, such as improved cloud point, pour point, and cold filter plugging point. Such improved cold flow properties can be obtained by dewaxing techniques.

Conventional three-phase hydroprocessing units used for hydrotreating and high pressure hydrocracking, commonly known as trickle bed reactors, require hydrogen from a vapor phase to be transferred into liquid phase where it is available to react with a hydrocarbon feed at the surface of the catalyst. These units are expensive, require large quantities of hydrogen, much of which must be recycled through expensive hydrogen compressors, and result in significant coke formation on the catalyst surface and catalyst deactivation.

Alternative hydroprocessing approaches include hydrotreating and hydrocracking in a once-through flow scheme as proposed by Thakkar et al. in "LCO Upgrading A Novel Approach for Greater Value and Improved Returns" AM, 05-53, NPRA, (2005). Thakkar et al. disclose upgrading a light cycle oil (LCO) into a mixture of liquefied petroleum gas (LPG), gasoline and diesel products. Thakkar et al. disclose producing a low sulfur content diesel (ULSD) product. However, Thakkar et al. use traditional trickle bed reactors, which require large quantities of hydrogen and large process equipment such as a large gas compressor for hydrogen gas circulation. Significant amounts of light gas and naphtha are produced in the disclosed hydrocracking process. The diesel product accounts for only about 50%, or less, of the total liquid product using LCO feed.

Ackerson, in U.S. Pat. No. 6,123,835, the subject matter of which is herein incorporated by reference, discloses a liquid-full, two-phase hydroprocessing system which eliminates the need to circulate hydrogen through the catalyst. In the liquid-full, two-phase hydroprocessing system, a solvent (or a recycled portion of hydroprocessed liquid effluent) acts as diluent and is mixed with a hydrocarbon feed. Hydrogen is dissolved in the feed/diluent mixture to provide hydrogen in the liquid phase. All of the hydrogen required in the hydroprocessing reaction is available in solution. Thus, no additional hydrogen is required and hydrogen recirculation is avoided and trickle bed operation of the reactor is avoided.

US Patent Application Publication Number 2012/0004477 (US' 477) discloses that hydrocarbon feeds can be hydrotreated in a continuous gas phase environment to reduce the sulfur and nitrogen content, and then dewaxed in a liquid-continuous reactor. US '477 discloses that the liquid-continuous reactor can advantageously be operated in a manner that avoids the need for a hydrogen recycle loop. The disclosed method for making diesel fuel product includes contacting a feedstock with a hydrotreating catalyst under effective hydrotreating conditions in a hydrotreatment reactor that includes a continuous gas phase to make a hydrotreated effluent; separating the hydrotreated effluent into at least a hydrotreated liquid product and a gas-phase product (the gas-phase product can include $H_2$, $H_2S$, and $NH_3$) to produce a hydrotreated dewaxing input stream, and contacting the hydrotreated dewaxing input stream with a dewaxing catalyst under effective catalytic dewaxing conditions in a liquid-continuous reactor to form a dewaxed effluent with a cold flow property that is at least about 5° C. less than a corresponding cold flow property of the feedstock. The gas-phase product can be used to provide recycled hydrogen for the hydrotreatment stage and/or a portion mixed with the hydrotreated effluent to form the hydrotreated dewaxing input stream.

US Patent Application Publication Number 2010/0176027 (US' 027) discloses an integrated process for producing diesel fuel from feedstocks, including diesel fuel production under sour conditions. The ability to process feedstocks under higher sulfur and/or nitrogen conditions allows for reduced cost processing and increases the flexibility in selecting a suitable feedstock. Moreover, in a disclosed embodiment, product from a hydrotreatment stage is directly cascaded into a catalytic dewaxing reaction zone. No separation is required between the hydrotreatment and catalytic dewaxing stages. Specific catalysts that are more tolerant of contaminants, such as sulfur and nitrogen, compared to conventional dewaxing catalysts are disclosed.

Although substantial improvements have been made in the arts of hydrotreating and dewaxing diesel fuel, the search continues for more robust, economical processes to produce LSD and ULSD with improved cold flow properties.

BRIEF SUMMARY OF THE DISCLOSURE

The present disclosure provides a high yield liquid-full process for reducing the sulfur and/or nitrogen content of middle distillate fuel feedstock and improving at least one cold flow property of the middle distillate fuel feedstock. The liquid-full process comprises the steps of: (a) contacting the feedstock with (i) a diluent and (ii) hydrogen, to produce a feedstock/diluent/hydrogen mixture, wherein the hydrogen is dissolved in the mixture to provide a liquid feed; (b) contacting the feedstock/diluent/hydrogen mixture with a hydrotreating catalyst in a first reaction zone, to produce a first product effluent; and (c) contacting the first product effluent with a dewaxing catalyst in a second reaction zone, to produce a second product effluent comprising naphtha and a middle distillate product; wherein the middle distillate product has at least one improved cold flow property compared to the middle distillate fuel feedstock and has the yield of at least 85 wt %.

DETAILED DESCRIPTION

Figure 1:
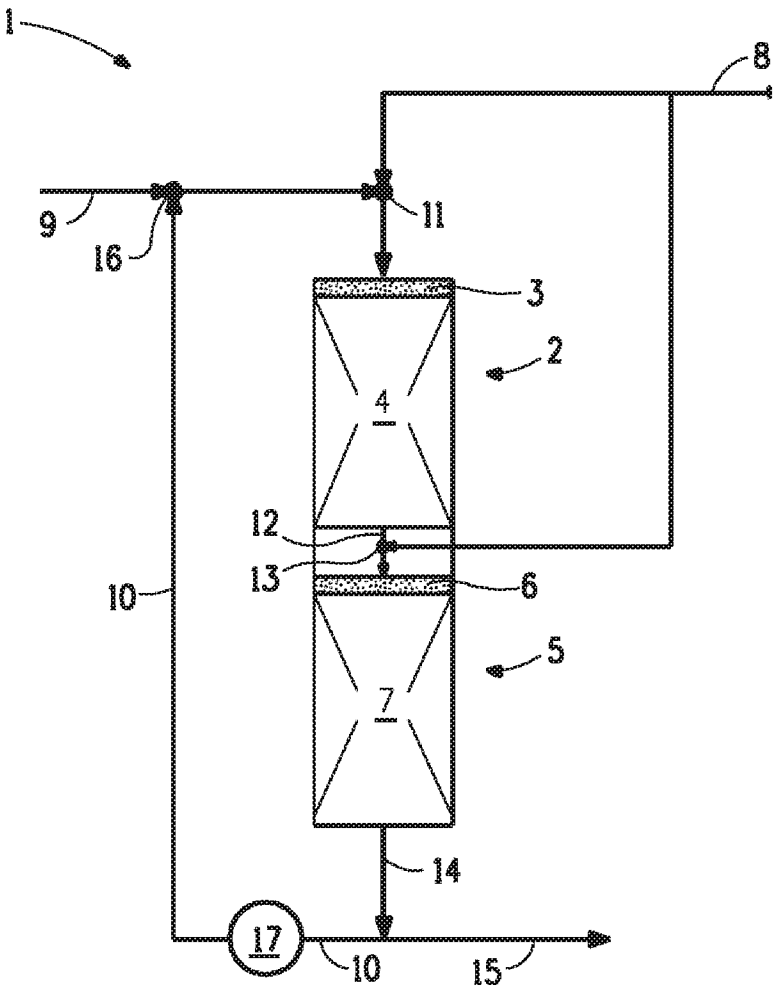
FIG. 1 is a schematic drawing of a first embodiment according to the present disclosure.

The foregoing general description and the following detailed description are exemplary and explanatory only and are not restrictive of the invention, as defined in the appended claims. Other features and benefits of any one or more of the embodiments will be apparent from the following detailed description, and from the claims.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Unless otherwise defined, all technical and scientific terms used herein have the same meaning as commonly understood by one of ordinary skill in the art to which this invention belongs. In case of conflict, the present specification, including definitions, will control. Although methods and materials similar or equivalent to those described herein can be used in the practice or testing of embodiments of the present invention, suitable methods and materials are described below. In addition, the materials, methods, and examples are illustrative only and not intended to be limiting.

When an amount, concentration, or other value or parameter is given as either a range, preferred range or a list of upper preferable values and/or lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range.

Before addressing details of embodiments described below, some terms are defined or clarified.

The term "wppm", as used herein, means parts per million by weight.

The term "zeolite catalyst", as used herein, means a catalyst comprising, consisting essentially of, or consisting of a zeolite.

The term "hydroprocessing", as used herein, means any process that is carried out in the presence of hydrogen, including, but not limited to, hydrogenation, hydrotreating, hydrocracking, dewaxing, hydroisomerization, and hydrodearomatization.

The term "hydrotreating", as used herein, means a process in which a hydrocarbon feed reacts with hydrogen, in the presence of a hydrotreating catalyst, to hydrogenate olefins and/or aromatics or remove heteroatoms such as sulfur (hydrodesulfurization), nitrogen (hydrodenitrogenation, also referred to as hydrodenitrification), oxygen (hydrodeoxygenation), metals (hydrodemetallation), asphaltenes, and combinations thereof.

The term "dewaxing", as used herein, means that at least some of the normal paraffin (N-paraffin) content of a middle distillate fuel feedstock is transformed to iso-paraffin content in the presence of a dewaxing catalyst.

The term "naphtha" or "naphtha product", as used herein, means the distillate volume fraction from about 100° C. to less than 160° C.

The term "middle distillate product", as used herein, means the distillate volume fraction from 160° C. to about 400° C.

The term "yield of the middle distillate product", as used herein, means the weight percentage of the middle distillate product compared to the total weight of naphtha and middle distillate product contained in the final product effluent.

The term "n-paraffin" or "normal paraffin", as used herein, means the straight-chain alkanes.

The term "iso-paraffin", as used herein, means the branched-chain alkanes.

The term "iso- to n-paraffin ratio", as used herein, means the weight ratio of the iso-paraffin content to n-paraffin content contained in the final product effluent.

The term "final product effluent", as used herein, means the product effluent produced in the final reaction zone. For example, when the hydroprocess only has one hydrotreating zone followed by one dewaxing zone, the dewaxing zone is the final reaction zone, and the product effluent produced in the dewaxing zone is the final product effluent. When the dewaxing zone above is followed by a second hydrotreating zone, such second hydrotreating zone is the final reaction zone, and the product effluent produced in the second hydrotreating zone is the final product effluent.

The present disclosure provides a new, economical, high yield process for reducing the sulfur and/or nitrogen content of a middle distillate fuel feedstock by a liquid-full hydrotreating step, as well as improving the cold flow properties of the fuel feedstock by a liquid-full dewaxing step. It has been surprisingly discovered that the hydrotreated middle distillate fuel feedstock, which contains $H_2S$ and $NH_3$ dissolved therein, can be successfully dewaxed in the presence of a zeolite catalyst without removing the $H_2S$ and $NH_3$ dissolved in the hydrotreated fuel feedstock prior to dewaxing. One challenge to the catalytic dewaxing is that the dewaxing catalysts are typically vulnerable to the $H_2S$ and/or $NH_3$ dissolved in the hydrocarbon feed. It has been surprisingly discovered that by keeping $H_2S$ and $NH_3$ generated during hydrotreatment in the product effluent (e.g., first product effluent) fed to the dewaxing zone, a zeolite catalyst under the conditions of this disclosure not only can successfully transform n-paraffin to iso-paraffin, but also has substantially reduced selective hydrocracking (C—C bond breaking) activity.

The present disclosure provides a liquid-full process for hydroprocessing a middle distillate fuel feedstock. The process comprises: (a) contacting the feedstock with (i) a diluent and (ii) hydrogen, to produce a feedstock/diluent/hydrogen mixture, wherein the hydrogen is dissolved in the mixture to provide a liquid feed; (b) contacting the feedstock/diluent/hydrogen mixture with a hydrotreating catalyst in a first reaction zone, to produce a first product effluent; and (c) contacting the first product effluent with a dewaxing catalyst in a second reaction zone, to produce a second product effluent comprising naphtha and a middle distillate product; wherein the middle distillate product has at least one improved cold flow property compared to the middle distillate fuel feedstock and has the yield of at least 85 wt %. In some embodiments of this invention, the second product effluent is recovered.

In some embodiments of this invention, the liquid-full process above further comprises contacting the second product effluent with a hydrotreating catalyst in a third reaction zone to produce a third product effluent. In some embodiments of this invention, the hydrotreating catalyst employed in the third reaction zone is the same as the hydrotreating catalyst used in the first reaction zone. In some embodiments of this invention, this further hydrotreating step removes sulfur compounds, such as mercaptans formed during the dewaxing step, from the second product effluent. In some embodiments of this invention, the second and the third product effluents have substantially the same naphtha and middle distillate product content, cold flow properties and iso- to n-paraffin ratio.

In some embodiments of this invention, steps (b) and (c) above are conducted in a single reactor containing one or more catalyst beds. For example, steps (b) and (c) above can be conducted in a single reactor containing one or more hydrotreating catalyst beds followed by one or more dewaxing catalyst beds. In some embodiments of this invention, this single reactor can also contain one or more catalyst beds for the further hydrotreating step (third reaction zone) as described above.

In some embodiments of this invention, steps (b) and (c) above are conducted in separate reactors, each of the reactors containing one or more catalyst beds. When the further hydrotreating step (third reaction zone) is also involved, the one or more further hydrotreating catalyst beds can locate in the same reactor with one or more dewaxing catalyst beds, or in a separate reactor.

The hydroprocessing reactions of this invention take place in a liquid-full reaction zone. By "liquid-full" it is meant herein that substantially all of the hydrogen is dissolved in a liquid-phase hydrocarbon feed to a reaction zone wherein the liquid feed contacts a catalyst. Both the hydrotreating and dewaxing reaction zones are two-phase systems wherein the catalysts are solid phase and the feedstock, diluent, dissolved hydrogen, and product effluents are all in the liquid phase. In some embodiments of this invention, there is no gas phase in the hydrotreating or dewaxing reaction zone.

In some embodiments of this invention, the liquid-full hydroprocess can be conducted in a single reactor comprising a first, liquid-full hydrotreating reaction zone, a second, liquid-full dewaxing reaction zone, and optionally a third, liquid-full hydrotreating reaction zone. Each reaction zone may independently comprise one or more catalyst beds. In some embodiments of this invention, each of the first, liquid-full hydrotreating reaction zone, the second, liquid-full dewaxing reaction zone, and the third, optional liquid-full hydrotreating reaction zone may independently comprise one or more reactors in liquid communication, and each reactor may independently comprise one or more catalyst beds. In some embodiments of this invention, multiple hydrotreating reaction zones and dewaxing reaction zones can be employed. In embodiments of this invention, in a column reactor or other single vessel containing two or more catalyst beds or between multiple reactors, the beds are physically separated by a catalyst-free zone. Each reactor is a fixed bed reactor and may be of a plug flow, tubular or other design packed with a solid catalyst (i.e. a packed bed reactor).

A portion of a product effluent may be recycled as a diluent to be combined with the hydrocarbon feed and hydrogen. In some embodiments of this invention, a portion of the first product effluent is recycled for use as all or part of the diluent in the hydrotreating step (b). In some embodiments of this invention, fresh hydrogen is added to a liquid feed to the second reaction zone (dewaxing), and a portion of the final product effluent is recycled for use as all or part of the diluent to be combined with the first product effluent and the fresh hydrogen to form the liquid feed for the dewaxing step (c).

In some embodiments of this invention, the liquid-full hydroprocess is conducted with a single recycle loop. By "single recycle loop" is meant herein, a portion (based on the selected recycle ratio) of the final product effluent is recirculated from the outlet of the final reaction zone to the inlet of the first reaction zone. Thus, all catalyst beds in the process are included in the one recycle loop. There is no separate recycle for just the first reaction zone or just the second reaction zone. In some embodiments of this invention, the second reaction zone (dewaxing) is the final reaction zone, and a portion of the second product effluent is recycled for use as all or part of the diluent in the hydrotreating step (b). In some embodiments of this invention, the second product effluent is further hydrotreated in a third reaction zone to produce a third product effluent, and a portion of the third product effluent is recycled for use as all or part of the diluent in the hydrotreating step (b).

In some embodiments of this invention, hydrogen is recycled with the recycled product effluent, without loss of gas phase hydrogen. In some embodiments of this invention, a recycled product effluent is combined with fresh feedstock without separating ammonia, hydrogen sulfide and remaining hydrogen from the final product effluent.

The recycled product effluent provides at least a portion of the diluent at a recycle ratio in a range of from about 0.5 to about 8, preferably at a recycle ratio of from about 1 to about 5.

The diluent typically comprises, consists essentially of, or consists of a recycled product effluent. The recycle stream is a portion of the product effluent that is recycled and combined with the hydrocarbon feed before or after contacting the feed with hydrogen, preferably before contacting the feed with hydrogen.

In addition to recycled product effluent, the diluent may comprise any other organic liquid that is compatible with the middle distillate fuel feedstock and catalysts. When the diluent comprises an organic liquid in addition to the recycled product effluent, preferably the organic liquid is a liquid in which hydrogen has a relatively high solubility. The diluent may comprise an organic liquid selected from the group consisting of light hydrocarbons, light distillates, naphtha, and combinations thereof. More particularly, the organic liquid is selected from the group consisting of propane, butane, pentane, hexane or combinations thereof. When the diluent comprises an organic liquid, the organic liquid is typically present in an amount of no greater than 90%, based on the total weight of the feed and diluent, preferably 20-85%, and more preferably 50-80%. Most preferably, the diluent consists of recycled product effluent.

In addition to hydrogen added into the feedstock/diluent/hydrogen mixture to produce the liquid feed in step (a), fresh hydrogen can be added into the effluent from a preceding catalyst bed at the inlet of each catalyst bed. The added hydrogen dissolves in the liquid effluent in the catalyst-free zone so that the catalyst bed is a liquid-full reaction zone. Thus, fresh hydrogen can be added into the feedstock/diluent/hydrogen mixture or effluent from a previous reactor (in series) at the catalyst-free zone, where the fresh hydrogen dissolves in the mixture or effluent prior to contact with the catalyst bed. A catalyst-free zone in advance of a catalyst bed is illustrated, for example, in U.S. Pat. No. 7,569,136.

In some embodiments of this invention, the liquid-full hydroprocess is conducted in a single reactor containing one or more hydrotreating catalyst beds followed by one or more dewaxing catalyst beds, and fresh hydrogen is added at the inlet of each catalyst bed. In some embodiments of this invention, the liquid-full hydroprocess is conducted in a series of reactors, and fresh hydrogen is added at the inlet of each reactor.

In the hydrotreating step (b), organic nitrogen and organic sulfur are converted to ammonia and hydrogen sulfide respectively. In some embodiments of this invention, a portion or all of the first product effluent is directed to a high pressure separator or a flash unit where waste gases such as $H_2S$ and $NH_3$ are removed to produce a stripped stream before the stripped stream is fed to the second reaction zone (dewaxing).

In some embodiments of this invention, there is no separation of ammonia, hydrogen sulfide and remaining hydrogen from the product effluent from the first catalyst bed or the product effluent from the preceding bed prior to feeding the effluent to the subsequent bed. The resulting ammonia and hydrogen sulfide after the hydroprocessing steps are dissolved in the liquid product effluent. A recycled product effluent is combined with fresh feedstock without separating ammonia, hydrogen sulfide and remaining hydrogen from the final product effluent.

In some embodiments of this invention, the first product effluent includes $H_2S$ and $NH_3$ dissolved therein and is fed directly into the second reaction zone without separating ammonia, hydrogen sulfide and remaining hydrogen from the first product effluent.

The final product effluent can be recovered and may be processed further as desired. In some embodiments of this invention, the final product effluent can be separated into a naphtha product and a middle distillate product (e.g., using a fractionator). In some embodiments of this invention, both the middle distillate fuel feedstock and the middle distillate product are diesels. In some embodiments of this invention, the second product effluent is the final product effluent. In some embodiments of this invention, the third product effluent is the final product effluent.

In some embodiments of this invention, the yield of the middle distillate product is at least 80 wt %. In some embodiments, the yield of the middle distillate product is at least 85 wt %. In some embodiments, the yield of the middle distillate product is at least 90 wt %.

The middle distillate products produced in the hydroprocesses of this disclosure have improved cold flow properties, such as lower cloud point, lower cold filter plugging point and lower pour point compared to the middle distillate fuel feedstock. In some embodiments of this invention, the middle distillate fuel feedstock has a nitrogen content of at least 200 wppm, and the middle distillate product has a cloud point of at least 10° C., or 15° C., or 20° C. lower compared to the middle distillate fuel feedstock. In some embodiments of this invention, the middle distillate fuel feedstock has a nitrogen content of at least 90 wppm, and the middle distillate product has a cloud point of at least 20° C., or 25° C., or 30° C. lower compared to the middle distillate fuel feedstock.

The middle distillate products also have higher iso- to n-paraffin ratio compared to the middle distillate fuel feedstock. In some embodiments of this invention, the middle distillate fuel feedstock has a nitrogen content of at least 200 wppm, and the middle distillate product has an iso- to n-paraffin ratio increase of at least 1.0, or 1.5, or 2.0, or 2.5 compared to the middle distillate fuel feedstock. In some embodiments of this invention, the middle distillate fuel feedstock has a nitrogen content of at least 90 wppm, and the middle distillate product has an iso- to n-paraffin ratio increase of at least 10, or 15, or 18, or 20, or 25 compared to the middle distillate fuel feedstock.

Middle Distillate Fuel Feedstock

As used herein "middle distillate fuel feedstock" can be any suitable middle distillate feedstock. Middle distillate feedstocks comprise a range of products from the middle fraction of the crude oil barrel. These products include, for example, jet fuel, kerosene, diesel fuels, and heating oils. In an aspect of the invention the middle distillate fuel feedstock comprises, consists essentially of, or consists of diesel fuels.

Catalyst Used in Hydrotreatment Zone

The catalyst employed in the hydrotreatment zone (first reaction zone and third reaction zone if present) can be any suitable hydrotreating catalyst that results in reducing the sulfur and/or nitrogen content of the middle distillate fuel feedstock under the reaction conditions in the hydrotreatment zone. In some embodiments of this invention, the suitable hydrotreating catalyst comprises, consists essentially of, or consists of a non-precious metal and an oxide support. In some embodiments of this invention, the metal is nickel or cobalt, or combinations thereof, preferably combined with molybdenum and/or tungsten. In some embodiments of this invention, the metal is selected from the group consisting of nickel-molybdenum (NiMo), cobalt-molybdenum (CoMo), nickel-tungsten (NiW) and cobalt-tungsten (CoW). The catalyst oxide support is a mono- or mixed-metal oxide. Preferred oxide supports comprise materials selected from the group consisting of alumina, silica, titania, zirconia, kieselguhr, silica-alumina and combinations of two or more thereof. More preferred is alumina.

Catalyst Used in Dewaxing Zone

The catalyst employed in the dewaxing zone (second reaction zone) can be any suitable dewaxing catalyst capable of dewaxing the hydrotreated middle distillate fuel feedstock under the reaction conditions of this disclosure.

In some embodiments of this invention, the suitable dewaxing catalyst comprises, consists essentially of, or consists of a non-precious metal and an oxide support. In some embodiments of this invention, the suitable dewaxing catalyst comprises, consists essentially of, or consists of a non-precious metal loaded zeolite. In some embodiments of this invention, the metal is nickel, cobalt, iron, or combinations thereof, optionally combined with molybdenum and/or tungsten.

In some embodiments of this invention, the suitable dewaxing catalyst comprises, consists essentially of, or consists of a crystalline, microporous oxide structure without metal loaded on it. In some embodiments of this invention, the suitable dewaxing catalyst comprises, consists essentially of, or consists of a molecular sieve without metal loaded on it. Examples of molecular sieves include zeolites and silicoaluminophosphates.

In some embodiments of this invention, the suitable dewaxing catalyst comprises, consists essentially of, or consists of a zeolite without metal loaded on it. The dewaxing catalysts can include a suitable binder, such as alumina, titania, silica, silica-alumina, zirconia, and combinations thereof. In some embodiments of this invention, the suitable dewaxing catalyst comprises, consists essentially of, or consists of a zeolite and a binder, without metal loaded on them. In some embodiments of this invention, the zeolite has a 8-member ring structure, a 10-member ring structure, or a 12-member ring structure. In some embodiments of this invention, the zeolite has a 10-member ring structure. In some embodiments of this invention, the zeolite is selected from the group consisting of ZSM-48, ZSM-22, ZSM-23, ZSM-35, zeolite Beta, USY, ZSM-5, SSZ-31, SAPO-11, SAPO-41, MAPO-11, ECR-42, synthetic ferrierites, mordenite, offretite, erionite, chabazite, and combinations thereof.

Hydrotreatment Zone

The first reaction according to the present disclosure is to treat the middle distillate fuel feedstock in a liquid-full hydrotreatment zone to reduce the sulfur and/or nitrogen content of the feedstock.

As stated above, the middle distillate fuel feedstock is combined with a diluent and hydrogen, to produce a feedstock/diluent/hydrogen mixture, wherein the hydrogen is dissolved in the mixture to provide a liquid feed. The contacting operation to make the liquid feed mixture may be performed in any suitable mixing apparatus known in the art.

In step (a), the middle distillate fuel feedstock is contacted with a diluent and hydrogen. The feedstock can be contacted first with hydrogen and then with the diluent, or in some embodiments, first with the diluent and then with hydrogen to produce the feedstock/diluent/hydrogen mixture. In step (b), the feedstock/diluent/hydrogen mixture is contacted with a hydrotreating catalyst in the first reaction zone under suitable reaction conditions to produce hydrotreated middle distillate fuel feedstock (first product effluent).

In the liquid-full hydrotreatment zone organic sulfur and organic nitrogen are converted to hydrogen sulfide (hydrodesulfurization) and ammonia (hydrodenitrogenation), respectively. The resulting ammonia and hydrogen sulfide are dissolved in the product effluent. Although the prior art would suggest that the hydrogen sulfide and ammonia would have to be removed prior to dewaxing, or that expensive, specialty catalysts must be used, surprisingly, there is no requirement for the separation of ammonia and hydrogen sulfide from the first product effluent prior to feeding the first product effluent to the dewaxing zone. Indeed, surprisingly good cold flow properties can be obtained through dewaxing while using readily available, relatively inexpensive zeolite catalysts according to the present disclosure.

Dewaxing Zone

The first product effluent is fed into a liquid-full dewaxing zone (second reaction zone) comprising at least one dewaxing catalyst bed. The first product effluent is contacted with the dewaxing catalyst under conditions suitable to reduce the n-paraffin content of the middle distillate fuel sufficiently to improve at least one cold flow property of the middle distillate fuel. It has been surprisingly found that, under relatively mild reaction conditions, improved cold flow properties and very high middle distillate product yield can be obtained even though the first product effluent contains ammonia and hydrogen sulfide dissolved therein. Further, it has been found that surprisingly there is little or no coke formation on the catalyst surface even with the ammonia and hydrogen sulfide contaminants present in the first product effluent. While not wishing to be bound by theory, it is believed that dewaxing of this disclosure occurs primarily through isomerization of normal paraffin molecules, rather than through selective hydrocracking (C—C bond breaking) of normal paraffin molecules, resulting in very efficient yields of middle distillate product as well. If the hydrocracking is severe, significant amounts of naphtha and lighter hydrocarbons, which are considered as lower value products, may be produced.

Reaction Conditions

The process of the present disclosure can operate under a wide variety of conditions, from mild to extreme. Temperatures for the hydrotreatment zone (first reaction zone and third reaction zone if present) range from about 225° C. to about 425° C., in some embodiments from about 285° C. to about 400° C., and in some embodiments from about 340° C. to about 380° C. Temperatures for the dewaxing zone (second reaction zone) range from about 225° C. to about 425° C., in some embodiments from about 285° C. to about 400° C., and in some embodiments from about 300° C. to about 380° C. Hydrotreatment zone pressures range from about 3.0 MPa to about 17.5 MPa, in some embodiments from about 4.0 MPa to about 14.0 MPa, and in some embodiments from about 6.0 MPa to about 9.0 MPa. Dewaxing zone pressures range from about 3.0 MPa to about 17.5 MPa, in some embodiments from about 4.0 MPa to about 14.0 MPa, and in some embodiments from about 6.0 MPa to about 9.0 MPa.

The total amount of hydrogen fed to the hydrotreatment zone and the dewaxing zone ranges from about 70 normal liters of hydrogen per liter of feed (N l/l) to about 270 (N l/l), in some embodiments from about 100 (N l/l) to about 230 (N l/l), and in some embodiments from about 120 (N l/l) to about 200 (N l/l).

The middle distillate fuel feedstock is fed to the first reaction zone at a rate to provide a liquid hourly space velocity (LHSV) of from about 0.1 to about 10 $hr^{-1}$, in some embodiments about 0.2 to about 5 $hr^{-1}$, in some embodiments about 0.4 to about 2 $hr^{-1}$. The first product effluent is fed to the dewaxing zone at a rate to provide a LHSV of from about 0.1 to about 10 $hr^{-1}$, in some embodiments about 0.25 to about 7 $hr^{-1}$, in some embodiments about 0.5 to about 3 $hr^{-1}$.

DESCRIPTION OF THE FIGURE

FIG. 1 provides an illustration for one embodiment of the hydroprocesses of this disclosure. Certain detailed features of the proposed process, such as pumps and compressors, separation equipment, feed tanks, heat exchangers, product recovery vessels and other ancillary process equipment are not shown for the sake of simplicity and in order to demonstrate the main features of the process. Such ancillary features will be appreciated by one skilled in the art. It is further appreciated that such ancillary and secondary equipment can be easily designed and used by one skilled in the art without any difficulty or any undue experimentation or invention.

As shown in FIG. 1, the hydrotreatment and dewaxing unit 1 includes a hydrotreatment zone 2 (although not shown, more than one hydrotreatment zone can be provided) comprising a distribution zone 3 and hydrotreatment catalyst bed 4. Dewaxing zone 5 includes distribution zone 6 and dewaxing catalyst bed 7 located such that the hydrotreated middle distillate fuel feedstock (first product effluent) can be provided directly into contact with the dewaxing catalyst bed 7.

Hydrogen 8 is combined with middle distillate fuel feedstock 9 and diluent 10 (in this case a portion of the final product effluent is recycled and used as the diluent) at mixing point 11 and fed into the hydrotreatment zone 2 where, under appropriate reaction conditions, it reacts with the catalyst of hydrotreatment catalyst bed 4 to remove organic nitrogen and organic sulfur from the middle distillate fuel feedstock 9. Hydrotreated middle distillate fuel feedstock (first product effluent) 12 is mixed with additional hydrogen 8 at mixing point 13 and fed into the dewaxing zone 5, where it reacts with the catalyst of dewaxing catalyst bed 7, under appropriate reaction conditions, to reduce the n-paraffin content of the hydrotreated middle distillate fuel feedstock.

Dewaxed middle distillate effluent (second product effluent) 14 can then be separated into two streams, with a first stream 10 being recycled through pump 17 and used as diluent which is mixed with middle distillate fuel feedstock 9 at mixing point 16, and a second stream 15 fed to, for example, a fractionator to remove unwanted napthta, if present. Middle distillate product with low sulfur content and improved cold flow properties is recovered.

EXAMPLES

The following non-limiting examples are provided to further illustrate the present invention. The examples should not be viewed as limiting in any way the invention as disclosed and claimed.

Analytical Methods and Terms

ASTM Standards. All ASTM Standards are available from ASTM International, West Conshohocken, Pa., www.astm.org.

Amounts of sulfur and nitrogen are provided in parts per million by weight, wppm.

Total Sulfur was measured using ASTM D4294 (2008), "Standard Test Method for Sulfur in Petroleum and Petroleum Products by Energy Dispersive X-ray Fluorescence Spectrometry," DOI: 10.1520/D4294-08 and ASTM D7220 (2006), "Standard Test Method for Sulfur in Automotive Fuels by Polarization X-ray Fluorescence Spectrometry," DOI: 10.1520/D7220-06.

N-paraffin and iso-paraffin content were measured using D2425-04(2009), "Standard Test Method for Hydrocarbon Types in Middle Distillates by Mass Spectrometry" DOI: 10.1520/D2425-04R09.

Density was measured at 20° C. using ASTM D4052 -11, "Standard Test Method for Density, Relative Density, and API Gravity of Liquids by Digital Density Meter" DOI: 10.1520/D4052-11. ASTM D1250 -08, "Standard Guide for Use of the Petroleum Measurement Tables" DOI: 10.1520/D1250-08, was used to determine the density at 60° F. (16° C.).

Total Nitrogen was measured using ASTM D4629 (2007), "Standard Test Method for Trace Nitrogen in Liquid Petroleum Hydrocarbons by Syringe/Inlet Oxidative Combustion and Chemiluminescence Detection," DOI: 10.1520/D4629-07 and ASTM D5762 (2005), "Standard Test Method for Nitrogen in Petroleum and Petroleum Products by Boat-Inlet Chemiluminescence," DOI: 10.1520/D5762-05.

Aromatic content was determined using ASTM Standard D6591-11 (2011), "Standard Test Method for Determination of Aromatic Hydrocarbon Types in Middle Distillates—High Performance Liquid Chromatography Method with Refractive Index Detection", DOI: 10.1520/D6591-11 and ASTM Standard D5186-03(2009), "Standard Test Method for Determination of Aromatic Content and Polynuclear Aromatic Content of Middle distillate Fuels and Aviation Turbine Fuels by Supercritical Fluid Chromatography", DOI: 10.1520/D5186-03R09.

Cloud point is an index of the lowest temperature of the utility of a petroleum product for certain applications. Cloud point was determined by ASTM Standard D2500-09 "Standard Test Method for Cloud Point of Petroleum Products", DOI: 10.1520/D2500-09.

Cold Filter Plugging Point ("CFPP") is an estimate of the highest temperature, expressed in multiples of 1° C., at which a given volume of fuel fails to pass through a standardized filtration device in a specified time when cooled under the conditions prescribed in the test method. CFPP was determined by ASTM Standard D6371-05 (2010) "Standard Test Method for Cold Filter Plugging Point of Middle distillate and Heating Fuels", DOI:10.1520/D6371-05R10.

Pour Point is an index of the lowest temperature at which movement of the test specimen is observed under prescribed conditions of test. Pour Point was determined by ASTM D97-11 "Standard Test Method for Pour Point of Petroleum Products", DOI:10.1520/D0097-11.

"LHSV" means liquid hourly space velocity, which is the volumetric rate of the liquid feed divided by the volume of the catalyst, and is given in $hr^{-1}$.

"WABT" means weighted averaged bed temperature of a reaction bed.

Example 1

Two middle distillate feedstock samples were treated according to the present invention. Sample 1 was treated three times, with various reaction conditions being changed, as set forth below. Sample 2 was treated six times, with various reaction conditions being changed, as set forth below.

The properties of Sample 1 and Sample 2 prior to treatment are listed below in Table 1.

TABLE 1

| | Sample 1 | Sample 2 |
|---|---|---|
| Sulfur (wppm) | 9072 | 2789 |
| Nitrogen (wppm) | 96 | 226 |
| Density ($kg/m^3$) | 862.8 | 867.3 |
| Mono-aromatics (wt %) | 18.3 | 17.1 |
| Poly-aromatics (wt %) | 8.6 | 10.4 |
| Iso-paraffins (wt %) | 16.7 | 16.4 |
| N-paraffins (wt %) | 15.3 | 18.1 |
| Cloud Point (° C.) | −10 | 7 |
| Cold Filter Plugging Point (° C.) | −11 | 4 |
| Pour Point (° C.) | −21 | 2 |
| Iso- to N-paraffin ratio | 1.1 | 0.9 |

Three samples of Sample 1 (Sample 1a, Sample 1b, and Sample 1c) and three samples of Sample 2 (Sample 2a, Sample 2b, and Sample 2c) were hydrotreated and dewaxed according to the present invention as follows. An additional three samples of Sample 2 (cs1, cs2, and cs3) were hydrotreated as comparative samples that were not subjected to a dewaxing step.

The various reaction conditions for each sample run are listed in Table 2, along with measured values of obtained product.

Figure 2:
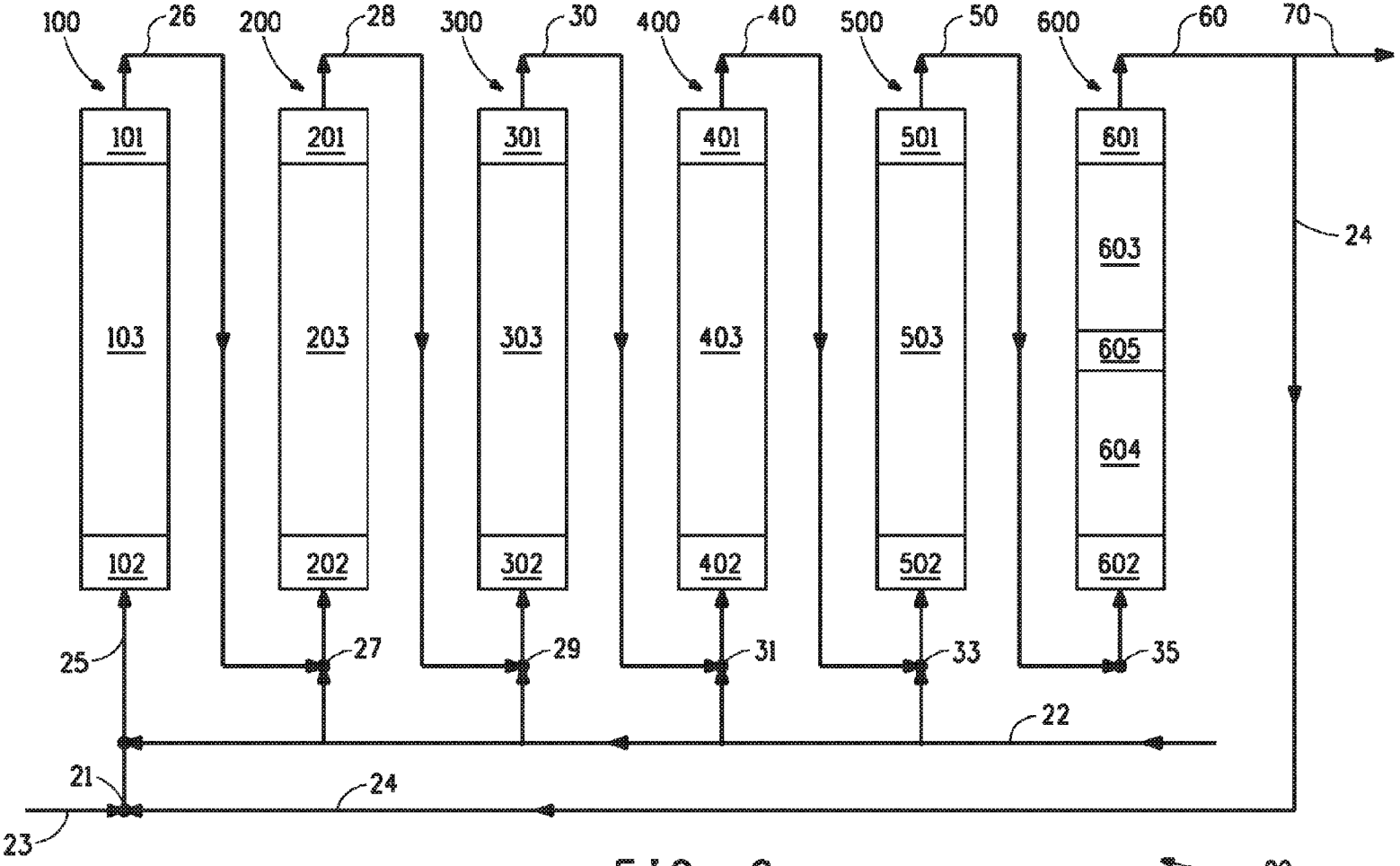
FIG. 2 is a schematic drawing of a hydrotreating and dewaxing system used in Example 1.

A hydrotreatment and dewaxing system according to the present invention comprising six liquid full reactors was used to treat Samples 1a-1c, Samples 2a-2c, and comparative samples cs1-cs3. The system 20 is depicted schematically in FIG. 2.

Six liquid full fixed bed reactors 100, 200, 300, 400, 500, and 600 were constructed of 316L stainless steel tubing in 19 mm (¾") OD and about 49 cm (19¼") in length with reducers to 6 mm (¼") on each end. Both ends of the reactors were first capped with metal screen to prevent catalyst leakage. Inside the metal screens, the reactors were packed with a layer of glass beads at both ends followed by a hydroprocessing and/or dewaxing catalyst packed in the middle section. Reactor 600 comprised two reaction zones, a hydrotreatment zone and a dewaxing zone, but packed with catalyst, with the zones being separated by a layer of glass beads.

Liquid full reactor 100 was packed with glass beads at each end 101 and 102. Reactors 200, 300, 400, 500, and 600 were all similarly packed with glass beads at each end (201, 202, 301, 302, 401, 402, 501, 502, 601, and 602, respectively). The middle sections 103, 203, 303, and 403 of reactors 100, 200, 300, and 400 were packed with a total of 180 mL of a Ni—Mo on $Al_2O_3$ hydrotreating catalyst. The middle section 503 of reactor 500 was packed with 60 ml of a dewaxing catalyst that was a 10-member ring zeolite without metal loaded on it. Reactor 600 included a dewaxing zone 604 packed with 30 ml of the above dewaxing catalyst followed by a hydrotreating zone 603 packed with 30 ml of the above hydrotreating catalyst. The hydrotreating zone and dewaxing zone were separated by a layer of glass beads 605.

Each liquid full reactor was placed in a temperature-controlled sand bath, consisting of a 120 cm long steel pipe filled with fine sand having 7.6 cm OD (3" Nominal). Temperatures were monitored at the inlet and outlet of each reactor. Temperature was controlled using heat tapes which were connected to temperature controllers and wrapped around the 7.6 cm O.D. sand bath. The sand bath pipe was wrapped with two independent heat tapes.

The hydrotreating and dewaxing catalysts were charged to the reactors and dried overnight at 115° C. under a total flow of 420 standard cubic centimeters per minute (sccm) of hydrogen gas. The reactors were heated to 176° C. with flow of charcoal lighter fluid (CLF) through the catalyst beds. Then, a sulfur spiked-CLF (1 wt % sulfur, added as 1-dodecanethiol) and hydrogen gas mixture was passed through the reactors at 176° C. to pre-sulfide the catalysts.

The pressure in each reactor was 7.0 MPa. The temperature was gradually increased from 176° C. to 232° C. and held for about 4 hours. The temperature was then gradually increased to 320° C. LHSV was adjusted to about 1.0 $hr^{-1}$. Pre-sulfiding was continued at 320° C. until breakthrough of hydrogen sulfide ($H_2S$) was observed at the outlet of reactor 600. After pre-sulfiding, the catalyst was stabilized by flowing Sample 1 through the catalysts in the reactors at a temperature varying from 320° C. to 355° C. and at pressure of 7.0 MPa (1000 psig) for approximately 10 hours.

Samples 1a-1c and 2a-2c

After pre-sulfiding and stabilizing the catalysts with Sample 1 at a pressure of 7.0 MPa, Samples 1 and 2 were hydrotreated and dewaxed according to the present disclosure.

Each of Samples 1 and 2 were run under three different reaction conditions as Samples 1 a, 1 b, 1 c, 2a, 2b, and 2c.

For each Sample, the pressure in each of the reactors was 13.9 MPa, the recycle ratio was 2.0, the LSHV was varied between 0.5 and 1.0 $hr^{-1}$ for the hydrotreating zone. Hydrogen gas 22, fed from compressed gas cylinders, was metered using dedicated mass flow controllers. The WABT of 366° C. was used for the hydrotreating beds. The WABT was maintained at 371° C. for the dewaxing beds. Reaction conditions for each Sample run are listed in Table 2.

All the runs were conducted as follows. At mixing point 21 of reactor 100, the fresh Sample feed stream 23 and a portion of the effluent 24 from reactor 600 (the liquid recycle stream) were mixed in a 6 mm OD 316L stainless steel tubing ahead of reactor 100. Hydrogen gas 22 was dissolved in the Sample feed stream 23 and effluent 24 mixture. The fresh Sample feed/hydrogen/liquid-recycle stream 25 was preheated in the 6-mm OD tubing in the temperature controlled sand bath and was then introduced to liquid full reactor 100.

After exiting reactor 100, additional hydrogen 22 was dissolved in the liquid product 26 of reactor 100 at mixing point 27 (feed to reactor 200). The feed to reactor 200 was again preheated in 6 mm OD tubing in a second temperature controlled sand bath and was then introduced to reactor 200 with hydrogen 22.

After exiting reactor 200, additional hydrogen 22 was dissolved in the liquid effluent 28 of reactor 200 at mixing point 29 (feed to reactor 300). The feed to reactor 300 was again preheated in 6 mm OD tubing in a third temperature controlled sand bath and was then introduced to reactor 300 with hydrogen 22.

After exiting reactor 300, additional hydrogen 22 was dissolved in the liquid effluent 30 of reactor 300 at mixing point 31 (feed to reactor 400). The feed to reactor 400 was again preheated in 6 mm OD tubing in a fourth temperature controlled sand bath and was then introduced to reactor 400 with hydrogen 22.

After exiting reactor 400, additional hydrogen 22 was dissolved in the liquid effluent 40 of reactor 400 at mixing point 33 (feed to reactor 500). The feed to reactor 500 was again preheated in 6 mm OD tubing in a fifth temperature controlled sand bath and was then introduced to reactor 500 with hydrogen 22.

No additional hydrogen was provided to the liquid effluent 50 of reactor 500. The feed to reactor 600 was again preheated in 6 mm OD tubing in a sixth temperature controlled sand bath and was then introduced to reactor 600. The feed to reactor 600 was first introduced to the dewaxing zone 604 and then fed to the hydrotreatment zone 603.

After exiting reactor 600, the effluent 60 was split into a recycle stream 24 and a total product stream 70. The recycle product stream was mixed with the feedstock at mixing point 21. Samples were periodically taken and analyzed until it was determined that the system had reached steady state. Thereafter, samples were obtained and analyzed as follows. The total product from stream 70 was first analyzed for sulfur, nitrogen, mono-aromatics, poly-aromatics, and naphtha content. Results for each sample run are listed in Table 2. The total product sample was then distilled to remove naphtha and the remaining diesel product was analyzed for Cloud Point, Cold Filter Plugging Point (CFPP), Pour Point, n-paraffin content, and iso-paraffin content. The results for each distilled diesel sample are listed in Table 2.

Comparative Samples cs1, cs2, and cs3

After Samples 1 a, 1 b, 1 c, 2a, 2b, and 2c were hydrotreated and dewaxed, Sample 2 was run under three different reaction conditions as comparative samples cs1, cs2, and cs3.

The temperatures in reactors 100, 200, 300 and 400 were adjusted to 366° C., and the pressure was adjusted to 13.9

MPa (2000 psig). The temperatures in reactors 500 and 600 were adjusted to below 204° C., with no additional hydrogen flow provided to reactors 500 and 600. Thus, no dewaxing step was conducted on samples cs1, cs2, and cs3.

A positive displacement feed pump was adjusted to obtain the desired LHSV for each comparative sample through reactors 100, 200, 300, and 400 as reported in Table 2. Hydrogen gas 22, fed from compressed gas cylinders, was metered using dedicated mass flow controllers. The total hydrogen feed rate to each reactor 100, 200, 300, and 400 was adjusted to the desired amount. The pressure was nominally 13.9 MPa (2000 psig) in all six reactors. The recycle ratio was adjusted to 2.0. Samples were periodically taken and analyzed until it was determined that the system had reached steady state.

Samples from each cs1, cs2, and cs3 were then obtained and analyzed. Results are reported in Table 2.

TABLE 2

| Sample | Hydro-treatment zone LHSV (hr−1) | Dewax zone LHSV (hr−1) | Total H2 feed (N l/l) | Total H2 Consumed (Nl/l) | Sulfur content (wppm) | Nitrogen content (wppm) | Mono-aromatics (wt %) | Poly-aromatics (wt %) |
|---|---|---|---|---|---|---|---|---|
| Sample 1 | — | — | — | — | 9072 | 96 | 18.3 | 8.6 |
| Sample 2 | — | — | — | — | 2789 | 226 | 17.1 | 10.4 |
| 1a | 0.75 | 1.5 | 165 | 159 | 10 | 0.2 | 16.6 | 3.5 |
| 1b | 1.0 | 2.0 | 165 | 145 | 6 | 0.3 | 12.6 | 1.4 |
| 1c | 0.5 | 1.0 | 167 | 167 | 23 | 0.2 | 21.7 | 7.5 |
| 2a | 0.75 | 1.5 | 165 | 144 | 3 | 0.2 | 13.4 | 1.3 |
| 2b | 1.0 | 2.0 | 165 | 137 | 7 | 0.2 | 11.8 | 0.7 |
| 2c | 0.5 | 1.0 | 167 | 157 | 12 | 0.4 | 20.5 | 6.9 |
| cs1 | 0.5 | — | 141 | 113 | 15 | 0.2 | 11.6 | 1.1 |
| cs2 | 0.75 | — | 140 | 102 | 13 | 0.2 | 9.6 | 0.4 |
| cs3 | 1.0 | — | 140 | 100 | 12 | 0.2 | 10.3 | 0.1 |

| Sample | Naphtha (wt %) | Cloud Point (C.) | CFPP (C.) | Pour Point (C.) | n-paraffin (wt %) | Iso-paraffin (wt %) | Iso- to n-paraffin ratio |
|---|---|---|---|---|---|---|---|
| Sample 1 | — | −10 | −11 | −21 | 15.3 | 16.7 | 1.1 |
| Sample 2 | — | 7 | 4 | 2 | 18.1 | 16.4 | 0.9 |
| 1a | 10 | −39 | −40 | −59 | 1.3 | 30.0 | 23.1 |
| 1b | 7 | −30 | −38 | −57 | 1.8 | 28.1 | 15.6 |
| 1c | 12 | −40 | −41 | −59 | 1.0 | 29.6 | 29.6 |
| 2a | 9 | −12 | −15 | −32 | 7.4 | 20.3 | 2.7 |
| 2b | 7 | −4 | −7 | −15 | 10.0 | 18.7 | 1.9 |
| 2c | 10 | −14 | −27 | −57 | 5.9 | 22.0 | 3.7 |
| cs1 | — | 4 | 2 | −4 | 14.6 | 25.0 | 1.7 |
| cs2 | — | 6 | 3 | −1 | 17.0 | 20.1 | 1.2 |
| cs3 | — | 6 | 3 | −1 | 17.9 | 16.9 | 0.9 |

As can be seen from the data of Table 2, each Sample was treated at LHSV rates of 0.5, 0.75, and 1.0 $hr^{-1}$ in the hydrotreatment zones, and LHSV rates of 1.0, 1.5, and 2.0 $hr^{-1}$ in the dewaxing zones. Total amount of hydrogen fed and consumed for each example are shown.

Samples 1a, 1b, 1c, 2a, 2b, and 2c demonstrate the improved cold flow properties that may be obtained in accordance with the present invention. All cold flow property temperatures were significantly reduced. Moreover, the n-paraffin content of each Sample was shown to be substantially converted to iso-paraffin.

Comparative Samples (hydrotreating only) cs1, cs2 and cs3 from feed Sample 2 clearly demonstrate that comparatively little n-paraffin is converted to iso-paraffin when the dewaxing step according to the invention is not used. Moreover, the improvement in the cold flow properties is modest in these comparative samples.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification is to be regarded in an illustrative rather than a restrictive sense, and all such modifications are intended to be included within the scope of invention.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

It is to be appreciated that certain features are, for clarity, described herein in the context of separate embodiments, may also be provided in combination in a single embodiment. Conversely, various features that are, for brevity, described in the context of a single embodiment, may also be provided separately or in any subcombination.

What is claimed is:

1. A liquid-full process for hydroprocessing a middle distillate fuel feedstock, comprising:

(a) contacting the feedstock with (i) a diluent and (ii) hydrogen, to produce a feedstock/diluent/hydrogen mixture, wherein the hydrogen is dissolved in the mixture to provide a liquid feed;

(b) contacting the feedstock/diluent/hydrogen mixture with a hydrotreating catalyst in a first reaction zone, to produce a first product effluent; and (c) contacting the first product effluent with a dewaxing catalyst in a second reaction zone, to produce a second product effluent comprising naphtha and a middle distillate product;

wherein the middle distillate product has at least one improved cold flow property compared to the middle distillate fuel feedstock and has the yield of at least 85 wt %, and wherein the middle distillate fuel feedstock comprises a range of products from the middle fraction of a crude oil barrel.

2. The process of claim 1, wherein the middle distillate fuel feedstock has a nitrogen content of at least 200wppm, and the middle distillate product has a cloud point of at least 15° C. lower compared to the middle distillate fuel feedstock.

3. The process of claim 1, wherein the middle distillate fuel feedstock has a nitrogen content of at least 90 wppm, and the middle distillate product has a cloud point of at least 25° C. lower compared to the middle distillate fuel feedstock.

4. The process of claim 1, wherein steps (b) and (c) are conducted in a single reactor containing one or more catalyst beds.

5. The process of claim 1, wherein steps (b) and (c) are conducted in separate reactors, each of the reactors containing one or more catalyst beds.

6. The process of claim 1, wherein the first product effluent includes $H_2S$ and $NH_3$ dissolved therein and is fed directly into the second reaction zone without separating ammonia, hydrogen sulfide and remaining hydrogen from the first product effluent.

7. The process of claim 1, wherein the first reaction zone has a temperature in the range of about 225° C. to about 425° C. and a pressure in the range of about 3.0MPa to about 17.5MPa.

8. The process of claim 1, wherein the second reaction zone has a temperature in the range of about 225° C. to about 425° C. and a pressure in the range of about 3.0MPa to about 17.5MPa.

9. The process of claim 1, wherein both the middle distillate fuel feedstock and the middle distillate product are diesels.

10. The process of claim 1, wherein the dewaxing catalyst is selected from the group consisting of catalysts comprising a non-precious metal and an oxide support, catalysts comprising a crystalline, microporous oxide structure without metal loaded on it, and catalysts comprising a molecular sieve without metal loaded on it.

11. The process of claim 1, wherein the dewaxing catalyst comprises a zeolite.

12. The process of claim 1, wherein the dewaxing catalyst comprises a crystalline, microporous oxide structure without metal loaded on it.

13. The process of claim 1, wherein the dewaxing catalyst comprises a zeolite without metal loaded on it.

14. The process of claim 13, wherein the zeolite has a 8-member ring structure, a 10-member ring structure, or a 12-member ring structure.

15. The process of claim 1 further comprising contacting the second product effluent with a hydrotreating catalyst in a third reaction zone to produce a third product effluent.

16. The process of claim 1 further comprising recovering the second product effluent.

17. The process of claim 1 further comprising recycling a portion of the second product effluent for use as all or part of the diluent.

18. The process of claim 1, wherein the middle distillate fuel feedstock has a nitrogen content of at least 90wppm.

* * * * *